US009095227B2

(12) United States Patent
Tagle

(10) Patent No.: US 9,095,227 B2
(45) Date of Patent: Aug. 4, 2015

(54) HANDS-FREE SHOULDER CARRIER FOR CHILDREN

(71) Applicant: Reinold Tagle, Encinitas, CA (US)

(72) Inventor: Reinold Tagle, Encinitas, CA (US)

( * ) Notice: Subject to any disclaimer, the term of this patent is extended or adjusted under 35 U.S.C. 154(b) by 148 days.

(21) Appl. No.: 13/691,095

(22) Filed: Nov. 30, 2012

(65) Prior Publication Data

US 2014/0151415 A1 Jun. 5, 2014

Related U.S. Application Data

(60) Provisional application No. 61/673,083, filed on Jul. 18, 2012.

(51) Int. Cl.

| | |
|---|---|
| ***A44C 5/12*** | (2006.01) |
| ***B44D 3/14*** | (2006.01) |
| ***A47D 13/02*** | (2006.01) |

(52) U.S. Cl.

CPC ..... *A47D 13/025* (2013.01)

(58) Field of Classification Search

USPC ..... 224/159, 158, 671, 674, 648, 638, 637, 224/250

See application file for complete search history.

(56) References Cited

U.S. PATENT DOCUMENTS

| | | | | | |
|---|---|---|---|---|---|
| 3,610,489 | A * | 10/1971 | Parsons | 224/161 |
| 3,698,608 | A * | 10/1972 | Entwistle | 224/159 |
| 3,805,548 | A * | 4/1974 | Matwijcow | 63/8 |
| 3,968,910 | A * | 7/1976 | Dye et al. | 224/161 |
| 4,416,403 | A * | 11/1983 | Johnson | 224/161 |
| 4,484,700 | A * | 11/1984 | Bush | 224/161 |
| 4,674,299 | A * | 6/1987 | Azar | 63/7 |
| 4,746,044 | A * | 5/1988 | Arvizu et al. | 224/161 |
| 5,074,127 | A * | 12/1991 | Yurman | 63/3 |
| 5,437,402 | A * | 8/1995 | Ring | 224/159 |
| 6,098,856 | A * | 8/2000 | Reilly | 224/160 |
| 6,561,394 | B2 * | 5/2003 | Pripps et al. | 224/161 |
| 8,474,667 | B2 * | 7/2013 | Schwartz | 224/159 |
| 2002/0179654 | A1 * | 12/2002 | Pripps et al. | 224/161 |
| 2004/0025984 | A1 * | 2/2004 | Holemans et al. | 148/563 |
| 2009/0200346 | A1 * | 8/2009 | Long | 224/158 |
| 2010/0084445 | A1 * | 4/2010 | Schwartz | 224/159 |
| 2012/0018467 | A1 * | 1/2012 | Chiappini | 224/158 |

* cited by examiner

*Primary Examiner* — Justin Larson
*Assistant Examiner* — Lester L Vanterpool
(74) *Attorney, Agent, or Firm* — Donn K. Harms

(57) ABSTRACT

A child carrier and support apparatus for securing a child in a seated position atop a wearer's shoulders comprising a chest strap sized for encirclement of a torso of a body of a wearer which employs means for encircled engagement within a passage of the ankle or the leg adjacent to the ankle, of both legs of a child, sitting upon the shoulders of the wearer, to provide a means for preventing the child from falling rearward. In at least one preferred mode the means for encircled engagement is provided by a pair of ankle engagements which are pivotally engaged to the chest strap.

9 Claims, 3 Drawing Sheets

HANDS-FREE SHOULDER CARRIER FOR CHILDREN

This application claims priority to U.S. Provisional Patent Application Ser. No. 61/673,083 filed on Jul. 18, 2012 and incorporated in its entirety by reference thereto.

BACKGROUND OF THE INVENTION

1. Field of the Invention

The present invention relates to the carrying of children. More particularly the invention relates to a device configured to provide hands-free secure seating to a child occupying a seat atop the shoulders of an adult. The device provides a safer and more comfortable experience to both child and the carrying-adult therethrough the provision of strategically positioned and configured seat padding and retaining straps.

2. Prior Art

The carrying of children, especially toddlers, upon the shoulders of an adult or older sibling, has been a favorite mode of transport for the carried child throughout history. For the child, it is a chance to see the world from an entirely different perspective than walking, as well as a chance to rest small legs which must work twice as hard to keep up with walking adults. For the adult carrying the child, it is a mode of carrying the child to keep the child safe and above potential harm which might lurk on the ground. For example, it is also very helpful when walking in crowded places where the child may get stepped on or repeated from the adult, like busy transportation terminals, amusement parks, etc. It is also an easy manner to take control of the child's movement, without having to order the child, since most children will willingly and enthusiastically jump at the chance to ride above the crowd on the parent's shoulders.

However, for child and carrying-adult alike, the duration the child occupies the elevated position riding upon the shoulders, can render the ride less than pleasurable to both. For the carrying adult, the weight of the child upon their shoulders, and need to use their hands to control the child, can tend to cause muscle exertion and strain as does the compressive nature of the weight of the child against the adults muscles and bones, and the continual force of the child pulling on their head or neck to maintain themselves upright.

For the child, a bony adult can make for a rough ride. Further, for smaller children who may lack the muscle strength and coordination to hold their backs erect and the legs properly positioned over the shoulder, the ride can be uncomfortable or even scary.

The fear may not only be a problem with the child. The carrying adult of small children may be continually in fear of the child losing their grip or balance. Or, the non carrying adult walking with them may have the same fear since they have no feedback as to the child's dexterity and sense of balance. Carrying a child on ones shoulders has been practiced throughout history.

Conventionally, carrying a child on the shoulders has often required the holding of the child's ankles by the carrier's hands, wherein the child is stabilized and generally prevented from falling backwards. Moderately complicated framed carrying devices have also been used, wherein the child is placed in the framed carrying device and the carrying apparatus is fitted on the carrier's back or shoulders. Example can be found in U.S. Pat. Nos. 4,746,044; 6,098,856; and 6,561,394. However such conventional framed carrying devices are often heavy, cumbersome, and not easily portable. Further these and similar devices unnecessarily fully support the back and upper body of the child, when it is conventionally only required to secure the child at their ankles. In addition, these devices which fully support the child's back are intended for carrying young children or infants who may not have the muscle strength or coordination to support themselves in a upright seated posture.

As such there is a continuing and unmet need for a child carrier device employed for carrying a child atop the shoulders of an adult which eliminates the need for a bulky, rigid, and cumbersome frame yet still provides a secured and comfortable ride for the adult and child. Such a device should employ flexible webbing type straps to provide a flexible yet sturdy frame which can be engaged about the users upper body and shoulders. The device should employ means to secure the ankles of the child when in the carrying position atop the users shoulders and additionally provide a seat configuration to further aid in distribution the weight load about the users for improved comfort and ease of use. Further, in an as used position, such a device should be hands free for the carrying adult. Still further, it is preferred that such a device should be employable with young children who are developed enough to maintain themselves in an upright seated posture without the aid of a full back rest.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of child carrier and securement device for providing secure and comfortable seating to a child occupying a seat atop the shoulders of an adult.

In accordance with a first preferred mode, the carrier and securement device is comprised a strap member configured for an engagement around the upper chest or bust of the adult user. The chest strap may be formed from conventional materials such as fabric or fabric webbing however can be formed of any material suitable for the purposes set forth in this disclosure. Further, the chest strap may be padded or otherwise cushioned to provide additional comfort to the adult user. To accommodate various bust sizes, the strap may be length adjustable and employ fasteners to allows the user to easily engage and disengage the device from the as used position. Types of fasteners may include plastic fasteners, snap fits, buckles, hook and loop fasteners, and others suitable fasteners known in the art.

In another preferred mode, the chest strap is adjustable via a tightening or loosening of a distal end of the strap relative the buckle or other fastener. This adjustability can be compared to that employed in conventional backpack shoulder straps, and the like. However, additional utility is provided in that the distal end of adjustable strap may be form in a substantially T-shaped cross section, similar to that found in M.O.L.L.E (Modular Lightweight Load-carrying Equipment) straps. In this mode, after securing the buckle or other fastener, the distal end of the strap can be communicated back over the buckle and secured to the opposite side of the chest strap and provide a redundant safety securement of the chest strap around the users chest.

The device additionally includes ankle securement members. In the as used mode with the device engaged about the bust of the adult user, and with the child in a conventional seated position atop the users shoulders such that the child's legs dangle over the users chest, the ankle securement members are configured to engaged about the ankles or legs of the child's feet. This will eliminate the requirement for the user to hold the child's ankles as is conventionally done to stabilize and prevent the child from falling backwards. It is intended that the ankle securement member will provide comparable if not greater stabilization than that of an adult user gripping by hand. Thus, the device provides a 'hands free' securement device for a child positioned atop the users shoulders.

In accordance with another preferred mode, the device includes a seating component configuration on the back of the device and therefor on the back of the users when in the as used mode, opposite the ankle securement members. In this mode the seating component may be formed from a flexible material such as fabric or the like. The seating component is preferably contoured to provide an ergonomic seating arrangement for the child, like a type of saddle. Those skilled in the art will recognize various ergonomic seating configurations, shapes, and contours which may be suitable for the intended purpose, and are anticipated and considered part of this disclosure. The saddle type configuration of the seating component will provide comfortable seating for the child without provide full back support, such that the child uses their back muscles to maintain an upright seating. However, in other modes if desired, the seating component can be designed with full back support.

The seating component preferably includes shoulder securement straps, which extend from the front of the chest strap and ankle securement members to an engagement with the seat. The straps may be padded or otherwise cushioned on one or both sides to provide comfort for both the carrying adult and seated child. The shoulder straps may be length adjustable. In one preferred mode, the exposed surface of the shoulder straps are preferably concaved. This concavity can be provided by formed padding which is concaved and can additionally provide a means for registered and padded engagement of the seated child's legs hanging over the adult's chest. This will provide comfort to the seated child over prolonged seating since their legs will not be rested against a raised or otherwise protruding surface of the strap.

As such the seating component is configured in a type of backpack configuration such that the weight of the child positioned in the seat is advantageously communicated to the shoulder straps and chest strap, and away from the users neck. Therefor the device provides a means to eliminate the stress and strain conventionally imparted on the user neck and back when carrying a child on their shoulders.

In accordance with at least one preferred mode of the invention, the ankle securement members are provided by substantially U-shaped members having hooked distal ends. The members are preferably formed from a flexible plastic or other suitable material. In use the child's ankles or other leg portion are engageable into the U-shaped members through a slight or moderate inward flexure of the distal ends. Securement is provided by the hooked distal ends which tend to resist an outward flexure therefor resisting disengagement of the child's ankles from the U-shaped members. However, disengagement can be accomplished by the adult user flexing the hooked ends outward.

Further, in yet another preferred mode, the U-shaped members may be rotatably engaged to the shoulder or chest straps. This will allows the child to maintain a natural leg position which may be slightly or moderately angled relative the vertical. Rotatably engagement can be accomplished by a swivel fastener, rotatable rivet, or other suitable means.

Still further, in yet another preferred mode, the ankle securement members can be provided straps having releasable fasteners. The straps may be padded or otherwise cushioned to provide additional comfort to the child. The releasable fasteners can be any suitable fastener such as buckle, hook and loop fasteners, or the like.

In all modes of the device, the ankle securement members may be engaged to one or both of the chest strap and shoulder straps.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the present invention provide a comfortable and hands free seating of a child atop an adult users shoulder.

It is another object to transfer the weight of the child atop the users shoulder away from the users head and neck.

It is another object of the invention to provide releasable ankle securement members for securing a child's legs and feet against the users chest in the as used mode.

These and other objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative of the invention herein, rather than limiting. In the drawings.

Figure 5B:
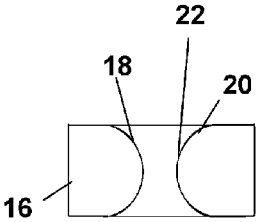
Figure 5A:
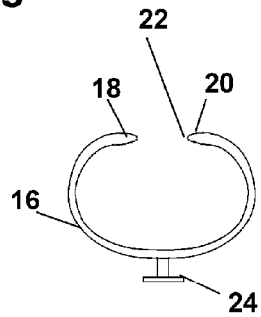

FIG. 5*a* depicts a top view of a first particularly preferred mode of the ankle engagement members.

FIG. 5*b* shows a front view of the mode of the ankle member of FIG. 5*a*.

Figure 6A:
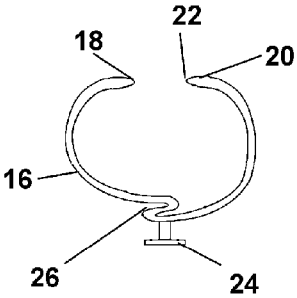

FIG. 6*a* depicts a top view of another particularly preferred mode of the ankle engagement members having a flexure portion.

Figure 6B:
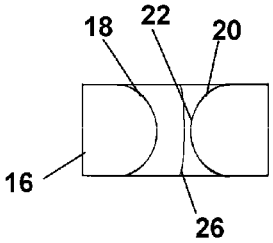

FIG. 6*b* shows a front view of the mode of the ankle member of FIG. 6*a*.

Figure 7:
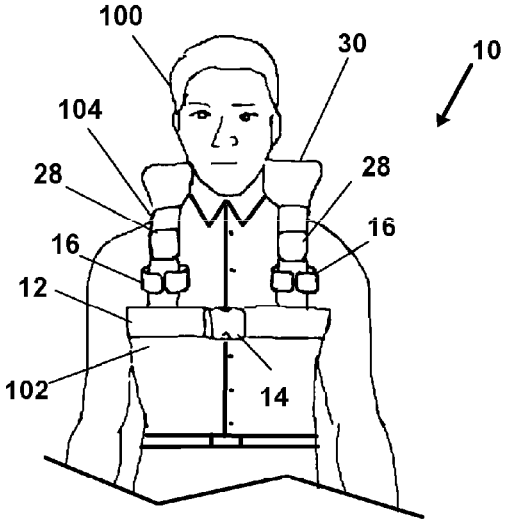

FIG. 7 shows a front view of another particularly preferred mode of the carrier and securement device employing a seating component in the as used position on a user.

Figure 8:
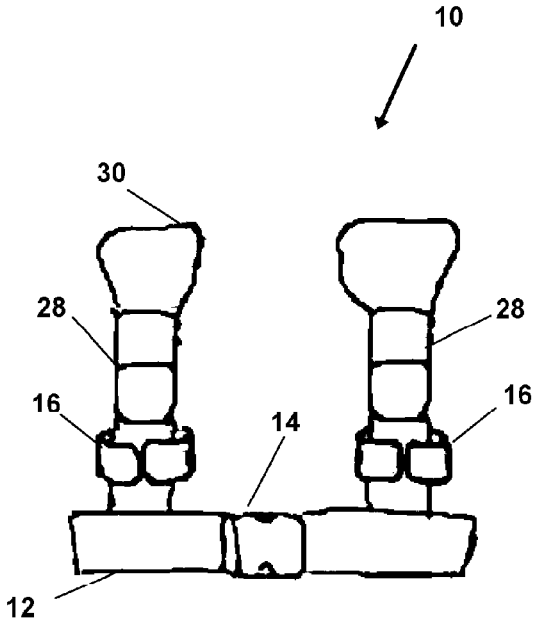

FIG. 8 shows a detailed front view of the device of FIG. 7.

Figure 9:
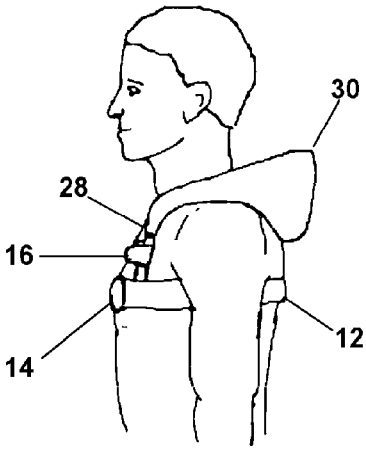

FIG. 9 shows a side view of the device of FIG. 7 in the as used mode.

Figure 10:
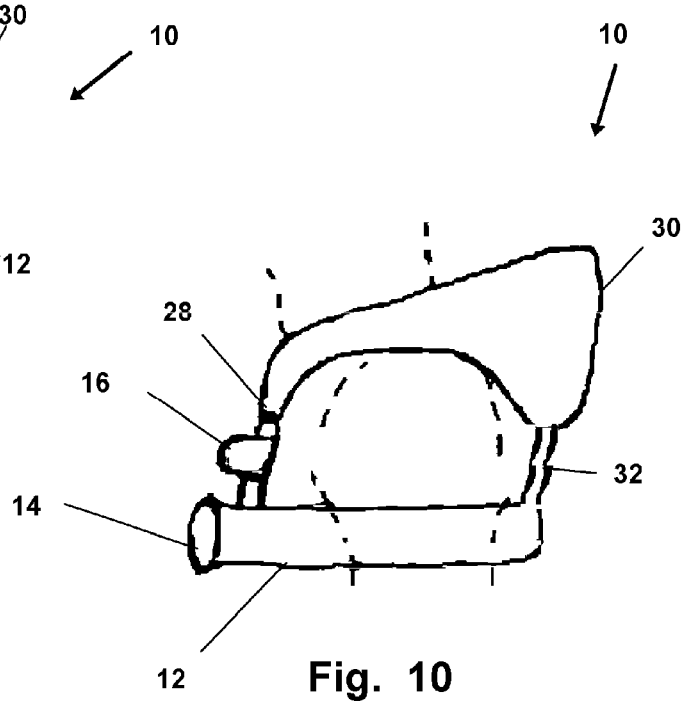

FIG. 10 shows a detailed side view of the device of FIG. 7.

Figure 11:
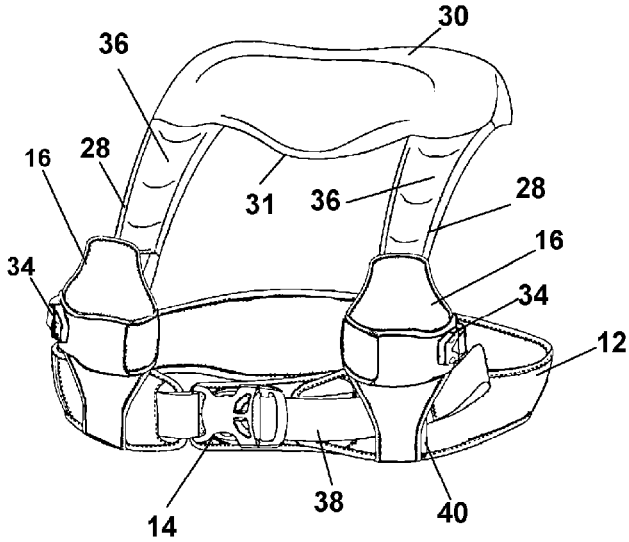

FIG. 11 shows a view of yet another particularly preferred mode of the device having padded straps and ankle securement members, also showing a preferred ergonomic seat and shoulder strap configuration.

Figure 12:
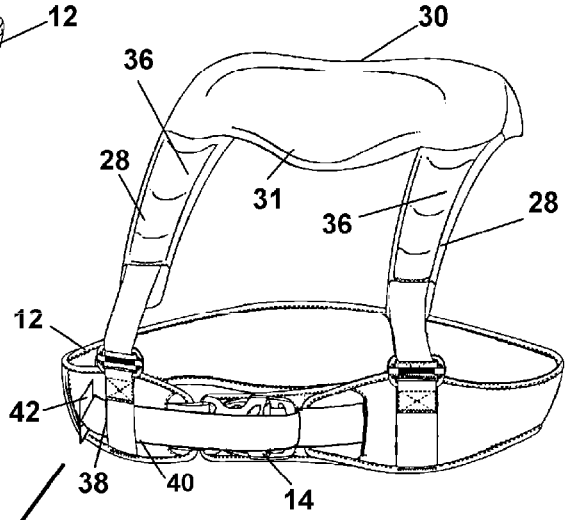

FIG. 12 shows a view of still yet another particularly preferred mode of the device without ankle securement members, and employing means for redundant securement the of the chest strap to the users bust for safety purposes.

Figure 13:
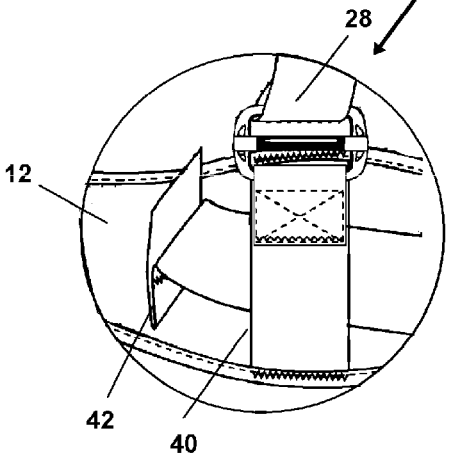

FIG. 13 shows a detailed view of the means for redundant safety securement employing MOLLE style straps.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
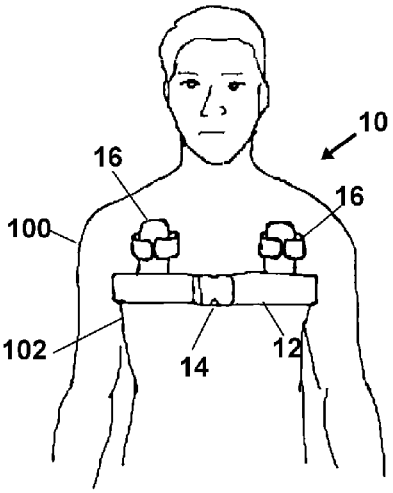
FIG. 1 shows a front view of a first particularly preferred mode of the securement device in the as used position on a user.
Figure 2:
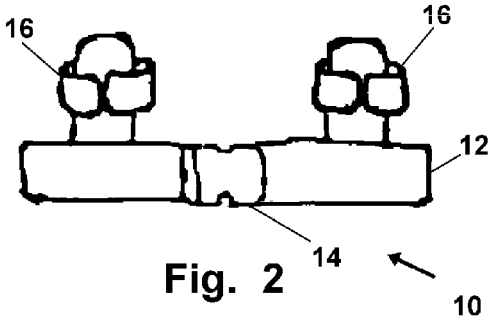
FIG. 2 shows a front view of the device of FIG. 1.
Figure 3:
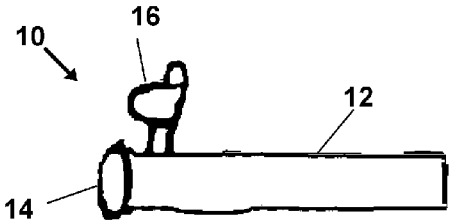
FIG. 3 shows a side view of the device if FIG. 1.
Figure 4:
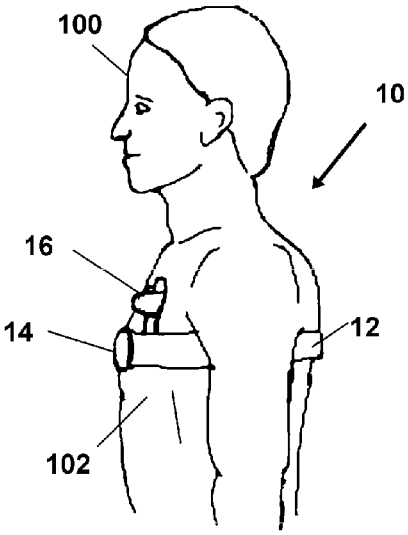
FIG. 4 shows a side view of the device of FIG. 1 in the as used position on a user.

Now referring to drawings in FIGS. 1-13, wherein similar components are identified by like reference numerals, there is seen in FIG. 1, FIG. 2, FIG. 3, and FIG. 4, respective views of a first particularly preferred mode of the child carrier and securement device 10. As shown in FIGS. 1 and 4 the device 10 is situated in the as-used mode engaged around the bust 102 of a user 100 who would be an adult or an adolescent large enough to comfortably support a child.

The device 10 includes a first flexible member defining the chest strap 12 which may be length adjustable, and includes a cooperatively engaging securing fastener 14 as a means for engagement of the first end of the chest strap 12 to the second end thereof. The fastener 14 may be a two-piece complimentary metal or plastic fastener where one component cooperatively engages the other, or any other suitable fastener known in the art for the secure engagement of distal ends of a strap to each other. Such means for strap fastening can include snap fits, two-piece mating snaps or clips, buckles, hooks and other strap fastening means adapted to provide removable, adjustable engagement of one end of the strap to the other. The various components of the device disclosed herein can be formed of conventional materials such as fabric, webbing, plastic, however can be formed of any material suitable for the purposes set forth in this disclosure.

The device 10 additionally includes flexible ankle securement members 16, engaged with a flexible mounting member 17 extending from a first end engagement with the chest strap 12. The ankle securement members 16 are engaged with a mounting member 17 engaged to the chest strap 12 to respective positions adapted to comfortably engage the ankles or legs adjacent to the ankles of a siting child, in a proper biomechanical posture and provide a means for encircled engagement thereof which is connected to the chest strap 12.

In an as-used engagement of the device 10, with the chest strap 12 sized to encircle the torso of a wearer between the waist and shoulders, a child seated atop the users shoulders, extends their legs over the users chest, which situates the child's feet, a distance below the top edge of the user's shoulder. The ankle securement members 16 are configured to engaged about the legs, at or adjacent to the ankles above the child's feet, to eliminate the need for the user to grab the child's leg adjacent to or at the angles by hand to provide securement. So engaged, the securement members 16 hold the child's legs against the wearer's torso and provide a means for preventing a rearward fall of the child, especially when the child removes his hands from the wearer's person.

Additionally, because the mounting member 17 is mounted at only a first end to the chest strap 12, whether formed of flexible or resilient material, it can act as a pivoting engagement to allow an angled positioning (A1 of FIG. 3) of the securement members 16, relative to the relatively perpendicular line (A of FIG. 3) which would be the case if the mounting members 17 were mounted on two ends, directly to the front of the chest strap 12. Since the mode of the device of FIGS. 1-6 would frequently be employed for an older child who has sufficient balance and coordination to keep themselves more secure atop the shoulders of the wearer, the pivoting mount providing the angled positioning of the mounting members 17 provides a means to align the axis of the internal cavity of the strap members 16 with the incoming angled lower leg of the child.

Thus the pivoting mounting members 17 accommodate kids with longer legs who may have to angle their lower leg, below the knee to properly position their legs adjacent the ankles within the strap members 16. The angled positioning represented by line A1 of FIG. 3, shows the angle the mounting member 17 will pivot to assume to provide an axial pathway within the strap members 17 for such a child with long legs.

Because this mode of the device 10, provides a much more comfortable fit to the child-user, it will encourage use and which will prevent chaffing and skin irritation the strap members 16 might cause on a child if not pivotally engaged by the hinge-like angling of the mounting member 17.

Still further, in a preferred mode of the securement members 16 employed with device 10 shown in FIG. 5*a* and FIG. 5*b*, the ankle securement members 16, which are secured to a mounting member 17 as in FIGS. 1-4, or other mounts as in FIGS. 7-13, is formed by substantially U-shaped individual members 16. The opposing members 16 as shown, permeably have an arc or hooked distal ends 18, 20, and a gap 22 extending therebetween. The hooked distal ends are formed by an arc portion at each distal end, which positions the distal edge of each distal end facing toward the front of the torso or body of the wearer slightly.

In this mode the ankle members 16 are preferably formed from a flexible member made of a polymer or plastic such as polypropylene, polyethylene, nylon, or other suitable material. In use, the child's ankles or adjacent leg portion are positionable through a gap 22 narrower than the width of the child or rider's leg, only by imparting force to the leg to push it through the narrower gap 22 between the distal end 18, 20, or by a spreading of the members 16 by the wearer. The leg moving in the gap in a direction toward the wearer, can more easily can separate the two distal ends and enlarge the gap 22 to the second or larger size to slip therethrough.

However, when the rider or child's leg is encircled by the two curved members 16, a force from the rider's leg in a direction away from the wearer's torso, in turn communicates leg force to both distal edges at the terminating distal ends the members 16 since the gap in the first position, is smaller then their leg width. The contact of their leg with the surfaces of the distal edges or ends at the ends of the hooked portions, causes a slight flexure of the hooked portion of the distal ends 18, 20, but in an inline direction away from the leg force contacting it. This contact makes it harder for the leg of the rider to separate the opposing members 16 and slide out of the passage or encircled engagement between them.

However, an outward flexure of the central portions of both members 16, in the area between their engagement to the mount, and the hooked portion distal ends, can be accomplished by a biasing of the two members in opposite directions by the hands of the wearer, or with extra force by the leg of the rider. The resulting flexure of the distal ends 18 and 20, and for larger legs the central area of the members 16, provides a means for increasing the size of the gap 22, to accommodate the child's leg area adjacent to their ankle, during ingress to the area surrounded by the interior surface of both members 16.

The flexible material forming the U-shaped members 16 is preferably resilient but elastic in nature such as molded polyethylene or polypropylene, or other resilient but flexible under force materials. As a consequence the biasing effect of the material to return to its original configuration, will then act to restore the members 16 to their originally formed relative positions, wherein the gap 22 is narrower than the width of the child rider's leg at or near the ankle such as from 0.5 inches to 1.5 inches.

Means for maintaining the legs secure from accidental disengagement and within the circular or oval area between the members 16, is provided by the hooked configuration with the distal ends 18 and 20 curving back toward the central portion of the respective body of the members 16 as in FIGS. 5*a* and 6*a*. Curved even so slightly to thereby position the distal tips of the distal ends 18 and 20 as the first contact point with the leg of a rider, the distal ends 18, 20 tend to resist the force in a direction away from the wearer's body, required for an outward flexure which would increase the gap 22 size.

Consequently, curving the distal ends 18 and 20 such that the distal tips are the first contact point during disengagement of a leg from the members 16, provides a means to prevent accidental disengagement of the child's ankles from the U-shaped members. In cases where the child can't lean forward and pull the members 16 in opposite directions to increase the gap, leg disengagement can be accomplished through the aid of an adult user who will impart force to pull apart the members 16 and/or hooked ends 18, 20, in opposite directions, to thereby temporarily increase the size of the gap 22 to one larger than the diameter of the child's leg.

In another preferred mode of the ankle members 16, providing additional comfort to the rider and wearer alike, which can be employed in all modes of the device herein, the ankle members 16, are rotatably engaged to the device 10 such as the mount 17 or the chest strap 12 where so configured. The ability to rotate the members 16 surrounding the child's leg during engagement therein, provides a means for the child to comfortably maintain a more natural biomechanical leg position. When sitting on the shoulders of the wearer, the child's legs may be slightly or moderately angled vertically, in radial directions around the center of each pair of members 16. This occurs when the legs of the rider or child are angled outward around the head of the wearer such that their knees are spaced from each other a distance wider than the spacing of the pairs of mount.

The rotatable or pivoting engagement of each pair of members 16, at their mounting point to the device 10, allows them to pivot and radially position the axial passage running through each pair of members 16, to match the line running through a sitting child's leg from their knee. A secure rotating or pivoting engagement can be accomplished by a swivel fastener 24, or similar rotatable rivet and aperture engagement, a fastener having an axle and bearing, or other suitable means for rotatable engagement.

FIG. 6*a* and FIG. 6*b* shows views of another particularly preferred mode of the ankle securement members 16 additionally including a flexure portion 26. The flexure portion 26 may be formed as shown to provide a means for biasing the distal ends 18, and 20, toward each other to a retracted or closed position to provide additional securement to maintain the gap 22 smaller than the diameter of the child's leg or ankle.

Additionally providing a flexure means also to allows the gap 22 to be easily increased by moving the two members 16 in opposite directions by an adult when needed. The flexure portion 26 may be provided by an accordion style folding of the ankle member 16 as shown, or other means. For example, the flexure portion 26 can be provide by a portion of flexible fabric, rubber, or the like.

FIG. 7, FIG. 8, FIG. 9, and FIG. 10 shows views of yet another particularly preferred mode of the child carrier and securement device 10 employing the provisions of the previous mode of the device 10 and additionally including a seating component 30. The seat 30 may be formed from a flexible and durable fabric, such that the device 10 can be folded or stored in a relatively small storage volume, however provide a secured seating configuration for a child when in the as used mode. In other modes of the device 10 shown in later figures, the seat 30 may be padded as well as ergonomically contoured as needed. As is shown the seating component 30 is engage to the chest strap 12 by at least one shoulder strap 28. Further, it is preferred that the ankle members 16 are engaged to the shoulder strap 28 as this configuration conventionally registers with the natural leg position of a child seated atop the users shoulders 104, or in the alternative, pivoting pairs of angle members 16 are employed to allow for angled engagement through the paired leg members 16 when the child's legs approach at an angle. However, other suitable configurations may be employed and are anticipated.

It is optional but preferred that the seat 30 includes a back strap 32 which engages the back of the seat 30 to the back of the chest strap 12. This will substantially increase the securement of the child in the seat 30 by limiting the vertical and horizontal motion of the seat 30 on the users shoulders at is restrained. The back strap 32 may also include a releasable fastener such as hook and loop fabric, or may be unitarily formed with the seat 30 and chest strap 12 by sewing, stitching, or other means.

The device 10 is configured to greatly reduce the stress and strain conventionally imparted on a users neck and back when carrying a child atop their shoulders by transmitting a substantial amount of the stresses to the shoulder straps 28 and chest strap 12. As such an adult can carry a child in such a position for longer and with much more comfort.

Additional securement and comfort may be provided by the modes of the device 10 shown in FIGS. 11 and 12. In FIG. 12, there is shown yet another particularly preferred mode of the device 10 having a seat 30 which is substantially contoured 31 having a lower mid section and a rear portion 31 higher in elevation than the mid section, or otherwise formed to the ergonomics of a sitting child. In this manner the seat 30 may take the form of a saddle or other such configuration. It is noted that those skilled in the art may recognize other contours, shapes, and configuration of the seat 30 to provide comfortable and ergonomic seating, and is anticipated. A rear portion 31 higher than the sunken mid portion, provides a means to prevent the child from falling backwards easily as it supports the lower back and is thus preferred, especially if the ankle members 16 are not employed.

Further, there is shown another preferred mode of the shoulder straps 28 which may be substantially padded or otherwise cushioned to provide added comfort. Additionally, it is clearly shown and preferred that at least one surface of the shoulder straps 28 are substantially concaved 36. This concavity 36 of the shoulder straps provides a means for a registered engagement of a seated child's legs extending over the users chest and inline with the shoulder straps 28. This is especially preferred since the child's legs can comfortably rest on the concave surface 36 without the discomfort of any protruding shoulder strap 28 material, and it provides better support during quick movements of the wearer to prevent a dismount of the rider. The concave surface 36 may be formed by inserting concave planar supports of polymer or plastic material into pockets in the formed strap material which may be seat belt type webbing formed or narrow weave nylon or polyester material.

Still further, yet another preferred mode of the ankle securement members 16 are shown herein formed as releasable straps. The ankle members 16 may be padded, and include a releasable fastener 34 such as a buckle or the like which will provide a means for removable secured engagement of the child's legs or ankles therein. In addition, the ankle members 16 may be permanently or removably engaged to the shoulder 28 and chest straps 12 via sewing or hook and loop fastener respectively, or other suitable means.

The adjustability of the chest strap 12 in the current mode is provided by an adjustable strap 38 which can be lengthened or shortened relative the secured fastener 14 being, for example, a conventional buckle as shown. Added utility is provided in that the distal end of the adjustment strap 38 can be tucked or otherwise secured within a passage 40 formed between the distal end of the shoulder strap 28 and the chest strap 12. The passage 40 can be formed by stitching or otherwise engaging only the terminating end of the shoulder strap 28 to the chest strap 12 and leaving a portion of the shoulder strap 28 disengaged such that the distal end of the adjustment strap 38 can be tucked under.

FIG. 12 and FIG. 13 show yet another particularly preferred mode of the device 10 wherein means for redundant safety securement of the chest strap 12 are provided. This mode may or may not include ankle members 16, however, in any mode of the device 10 previously it is preferred to include these provisions. As is shown the distal end 42 of the adjustment strap 38 is stitched, sewn, or otherwise formed into a substantially T-shaped cross section, similar to conventional MOLLE style straps. As such, after engaging the securing fastener 14 of the chest strap 12, the distal end 42 of the adjustment strap 38 can be communicated back over the fastener 14 and tucked in an engagement with the passage 40 formed on that side. Therefor, in the event of an accidental disengagement of the fastener 14, the adjustment strap 38 will provide an additional means for maintaining the chest strap 12 in a secured engagement until the user can re-engage the fastener 14.

It is noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

This invention has other applications, potentially, and one skilled in the art could discover these. The explication of the features of this invention does not limit the claims of this application; other applications developed by those skilled in the art will be included in this invention.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A child carrier and support apparatus for a child in a seated position atop a wearer's shoulders comprising:

a chest strap, having a first end and second end;

a removably engageable fastener securing said first end to said second end;

said chest strap having a circumference sized for encirclement of a torso of a body of a wearer, in an as-used position engaged thereon;

a first pair of leg engagement members connected to said chest strap and having a first passage therebetween;

a second pair of leg engagement members connected to said chest strap and having a second passage therebetween;

a seat, said seat engaged with said chest strap with a pair of support straps each extending between a first attachment to said seat and a second attachment to said chest strap;

said seat having a first surface contacting said user and having a second surface opposite said first surface;

said second surface having a rear edge portion opposite a forward edge positioned adjacent said user's head;

a depression formed into said seat between said rear edge portion and said forward edge;

each of said support straps having a rear surface positioned adjacent the body of said wearer, and having a concave front surface opposite said rear surface;

each said concave front surface forming a channel upon engageable with the curved surface of a respective leg of said child; and whereby said child, seated within said depression of said seat positioned upon said wearer's shoulders, with each leg positioned within one respective said channel of one of said respective support strap, is prevented from falling rearward from said shoulders by each leg engaged with one of said respective pair of leg engagement members, and afforded better support from falling during quick movements by said wearer, by said legs positioned within said channels.

2. The child carrier and support apparatus of claim 1 additionally comprising:

a first fastener to engage each said first pair of leg engagement members in a first engagement to each other, and a second fastener to engage each of said second pair of leg engagement members in a second engagement to each other.

3. The child carrier and support apparatus of claim 2 wherein:

said first fastener is configured to provide an overlapping engagement of said first pair of engagement members and thereby adjust a size of said first passage therethrough;

said second fastener is configured to provide an overlapping engagement of said second-pair of engagement members and thereby adjust a size of said second passage therethrough; and whereby said size of first passage and of said second passage is adjustable, to accommodate a size of said legs of said child restrained therein.

4. The child carrier and support apparatus of claim 1 wherein said circumference of said chest strap is adjustable by a sliding engagement of an adjustment portion of said chest strap in its attachment to a first half said removably engageable fastener.

5. The child carrier and support apparatus of claim 2 wherein said circumference of said chest strap is adjustable by a sliding engagement of an adjustment portion of said chest strap in its attachment to a first half of said removably engageable fastener.

6. The child carrier and support apparatus of claim 3 wherein said circumference of said chest strap is adjustable by a sliding engagement of an adjustment portion of said chest strap in its attachment to a first half said removably engageable fastener.

7. The child carrier and support apparatus of claim 4 additionally comprising:

a securement position for a distal end of said adjustment portion of said chest strap, for a secondary engagement of said chest strap adjacent an engagement thereof with a second half of said removably engageable fastener, whereby said chest strap remains secured around said wearer should said first half of said removably engageable fastener separate from an engagement with said second half of said removably engageable fastener.

8. The child carrier and support apparatus of claim 5 additionally comprising:

a securement position for a distal end of said adjustment portion of said chest strap, for a secondary engagement of said chest strap adjacent an engagement thereof with a second half of said removably engageable fastener, whereby said chest strap remains secured around said wearer should said first half of said removably engageable fastener separate from an engagement with said second half of said removably engageable fastener.

9. The child carrier and support apparatus of claim 5 additionally comprising:

a securement position for a distal end of said adjustment portion of said chest strap, for a secondary engagement of said chest strap adjacent an engagement thereof with a second half of said removably engageable fastener, whereby said chest strap remains secured around said wearer should said first half of said removably engageable fastener separate from an engagement with said second half of said removably engageable fastener.

* * * * *